United States Patent [19]

Gamarra

[11] Patent Number: 4,648,680

[45] Date of Patent: Mar. 10, 1987

[54] DROP-WIRE CLOSURE HAVING FIRST AND SECOND CAMS

[75] Inventor: Jose P. Gamarra, Union City, Calif.

[73] Assignee: Raychem Corporation, Menlo Park, Calif.

[21] Appl. No.: 698,644

[22] Filed: Feb. 6, 1985

[51] Int. Cl.[4] ..... H01R 4/40

[52] U.S. Cl. ..... 339/105

[58] Field of Search ..... 339/97 R, 97 P, 98, 339/99 R, 105, 274

[56] References Cited

U.S. PATENT DOCUMENTS

| | | | |
|---|---|---|---|
| 2,199,219 | 4/1940 | Edwards et al. | 339/105 |
| 2,283,544 | 5/1942 | Eaton | 339/105 |
| 2,359,541 | 10/1944 | Bancroft | 339/97 R |
| 2,727,116 | 12/1955 | Alfred et al. | 339/105 |
| 3,579,283 | 5/1971 | Welburn . | |
| 3,716,818 | 2/1973 | Finkelstein | 339/117 R |
| 4,157,208 | 6/1979 | Roberts et al. | 339/98 |
| 4,162,561 | 7/1979 | Tillemans | 339/105 |
| 4,190,222 | 2/1980 | Appleton . | |
| 4,224,465 | 9/1980 | Ruzic | 339/105 |
| 4,296,955 | 10/1981 | Martin . | |
| 4,362,352 | 12/1982 | Hawkins . | |
| 4,489,964 | 12/1984 | Kipp et al. . | |

FOREIGN PATENT DOCUMENTS

| | | | |
|---|---|---|---|
| 702691 | 3/1966 | Italy | 339/105 |

*Primary Examiner*—Joseph H. McGlynn

*Attorney, Agent, or Firm*—Ira D. Blecker; Dennis E. Kovach

[57] ABSTRACT

A closure includes pivoted cams which partially define variable-sized passageways. Each of the variable-sized passageways is suitably configured for receiving a cable. The cams pivot and decrease the size of the passageways in response to pull-out forces exerted on the cables located within the passageways.

12 Claims, 9 Drawing Figures

DROP-WIRE CLOSURE HAVING FIRST AND SECOND CAMS

CROSS-REFERENCE TO RELATED APPLICATIONS

Concurrently filed application entitled, "Drop-Wire Closure Having Insulation-Piercing Means," invented by Alvah A. Lawrence, describes and claims closures as embodied in FIGS. 5–6; concurrently filed application entitled, "Drop-Wire Closure Including Fixed-Sized Passageways," invented by Gerald Shimirak, and "Drop-Wire Closure Including Cable Organizer," invented by Peter Howard, claim closures as embodied in FIGS. 7–9. The disclosures of these related applications are incorporated herein by reference. The present invention relates to closures of the type illustrated in FIGS. 1–4.

BACKGROUND OF THE INVENTION

I. Field of the Invention

The present invention relates to a drop-wire closure, and also to a connector for connecting an electrical cable with an electrical drop wire.

II. Description of the Prior Art

Various connectors and closures are known in the art for connecting an electrical cable with an electrical drop wire. Such closures and connectors generally include means for splicing conductors of the cable with conductors of the drop wire. However, since oftentimes either the cable or the drop wire is subjected to severe axial loads as can be caused by dimensional changes induced by temperature variations, high winds, heavy weight loads (e.g., ice), etc., the means for connecting the electrical conductors necessarily must be capable of accommodating these loads to prevent pull-out of the drop wire from the cable. Such electrical connectors and closures are generally complicated in design and expensive, and nevertheless do not guarantee a sufficient degree of reliability for withstanding axial pull-out.

SUMMARY OF THE INVENTION

Accordingly, it is an object of the present invention to eliminate the above-noted drawbacks and to provide a drop-wire closure having first and second cam means which independently provide first and second variable-sized passageways in conjunction with first and second means confronting the first and second cam means, the cable and the drop wire being respectively disposed in the first and second passageways. With such an arrangement, when either the drop wire or the cable is subjected to an axial pull-out load, the cable or the drop wire, as the case may be, urges its cam means to rotate about a pin such that the size of its respective passageway is reduced, thus tightly clamping the cable or the drop wire, as the case may be, and relieving the splice therebetween of any stress which otherwise would be generated due to this load.

The invention is suitable for both aerial splices and buried splices, and preferably a casing including the cam means contains a water-repelling gel. In addition, the cam means preferably include a series of serrations on surfaces thereof confronting the cable and the drop wire for increasing a gripping force on the cable and the drop wire, and component parts of the closure can, if desired, be made of relatively inexpensive, lightweight materials, such as plastics. Though the cable and the drop wire can be electrically connected via a conventional splice, the closure of the invention preferably can include one or more electrical connecting bars to which the conductors of the cable and the drop wire can be connected for completing an electrical connection therebetween.

DESCRIPTION OF THE PREFERRED EMBODIMENTS

Figure 1:
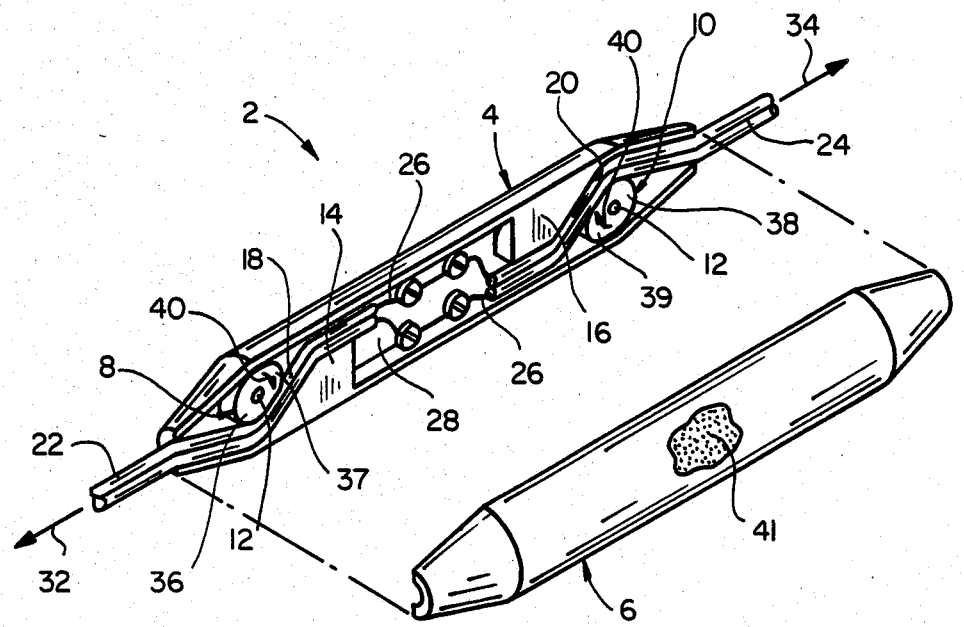
FIG. 1 illustrates a first preferred embodiment of the invention which includes first and second pivoted cams.

FIG. 1 illustrates an exploded perspective view of a first embodiment of the present invention. In FIG. 1, a closure 2 includes a casing comprising first and second casing halves 4, 6. First and second cams 8, 10 are pivotably mounted to the casing half 4 via pins 12. The cams are positioned so as to confront first and second shoulders 14, 16 which cooperate with the cams 8, 10 so as to define first and second variable-sized passageways 18, 20 through which extend first and second cables 22, 24. Conductors 26 of the cables are connected at a junction 28 by appropriate means (e.g., splices) and it should be understood the cables 22, 24 can consist of a single cable with the junction 28 being a repair region, for example.

With the construction of FIG. 1, if a pull-out force is exerted on either the cable 22 or the cable 24 along a direction indicated by the arrow 32 or 34, respectively, frictional engagement between the cable 22 or 24 with cam portion 36 or 38 of the cam 8 or 10 causes the respective cam to rotate around its respective pin 12 in a clockwise direction as viewed in FIG. 1 (in the direction of arrows 40) which causes a second cam portion 37, 39 to be urged towards its respective shoulder 14, 16 and narrow a size of the respective passageway 18, 20, thus tightly gripping the cable 22, 24 so as to resist pull-out thereof. If the closure is free to move with the cables, as in the aerial closure-connector design, it is readily apparent that tension on either of the cables 22 or 24 will cause both cams 8 and 10 to tightly clamp both cables 22 and 24 thus insuring that the splice or region between the cams is isolated from the pull-out force.

Accordingly, the cams and shoulders function to handle the pull-out load exerted on the cables 22, 24 thereby isolating junctions 28 from these pull-out forces.

Preferably, the cams 8, 10 have tooth surfaces thereon which engage the cables 22, 24 so as to increase gripping forces on the cables. In addition, an electrically insulating gel 41 can be disposed in the second casing half 6 so as to environmentally isolate the electrical conductors 26, cables 22, 24, and junction 28 and protect them from adverse environmental elements, such as water. The gel 41 can comprise a grease, but most preferably comprises a three-dimensional molecular structure having a cone penetration between 100 and 350 ($10^{-1}$ mm) and an ultimate elongation of at least 200%, such structures being formable out of urethane, silicon, or a non-silicon liquid rubber. Such gels are described and claimed in co-pending application Ser. Nos. 434,011 filed Oct. 12, 1982; 504,000, filed June 13, 1983; 507,435 filed June 23, 1983; and 656,555, filed Aug. 31, 1984, the disclosures of which are incorporated herein by reference. Hereinafter, reference to a "gel" is intended to mean any of the gels described in any of these applications. Though the gel 41 can be used to fill the casing halves 4, 6, it of course is apparent that this is not necessary and the invention is usable in an unfilled state also.

The cams 8, 10 preferably are removable and replaceable with cams having other sizes so as to be able to accommodate a wide variety of cable sizes, and the casing halves 4, 6 are preferably formed of plastic so that the closure 2 is relatively inexpensive, light in weight, and corrosion resistant. Since the casing halves 4, 6 can be readily secured by any appropriate means such as screws, re-entry is facilitated.

The invention is most suitable for use with aerial cables 24 wherein it is desired to utilize drop-wire splices extending therefrom, in which case the cable 22 would correspond to a drop-wire cable. For aerial closures, the cams adequately handle the axial loads created by high winds, ice, contraction in length of materials (e.g., cables) due to temperature variations, etc. The closure is similarly usable in buried cable systems as well, especially for drop-wire connections made therewith.

Figure 2:
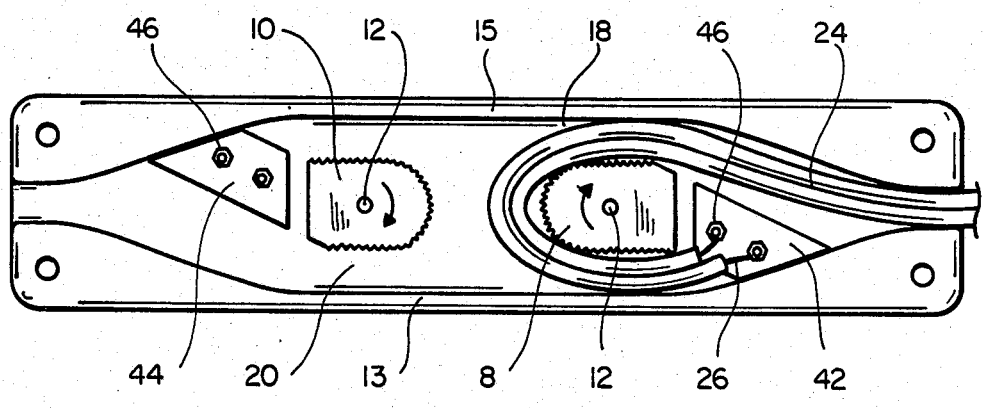
FIG. 2 illustrates an alternative embodiment which includes first and second fixed connection bars.

In the embodiment of FIG. 2, first and second connector mounting blocks 42, 44, each has a plurality of electrical connection ports 46 thereon adapted to be electrically connected to each of the conductors 26 of the cables. The connector block 42 is electrically connected with the connector block 44 so as to provide a means of electrically connecting the conductors of the cable 22 with the conductors of the cable 24. Again, in the embodiment of FIG. 2, cams 8, 10 are pivotably mounted so as to be rotatable about pins 12 and function to narrow the passageways 18, 20 between the cams and side walls 13, 15, when the cables 22, 24 are subjected to an axial load thus isolating the electrical connection ports 46 from the axial load. The embodiment of FIG. 2 is further advantageous in that each cable 22, 24 is wrapped around its respective cam over an arc in excess of, for example, 160°, and preferable in excess of 180°. Such extreme bending of the cables provides further pull-out resistance independent from that provided by the cams due to frictional engagement between the cam and the cable, as well as between the cable and members confronting the cam thus defining the variable-sized passageway.

Figure 3:
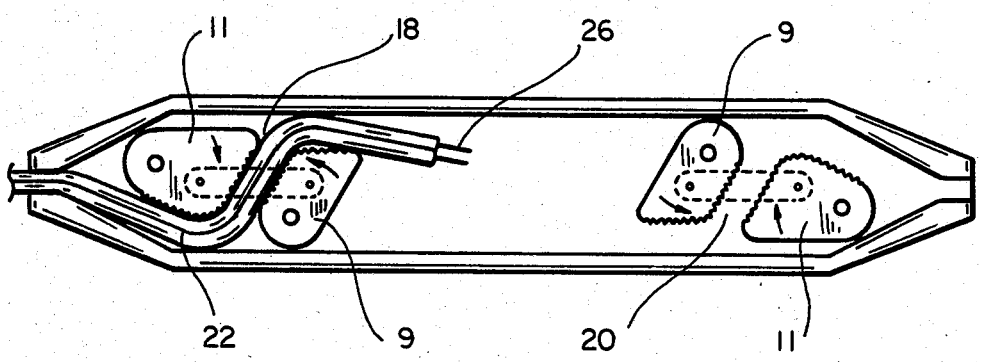
FIG. 3 illustrates an embodiment which utilizes four pivotable cams which define two variable-sized passageways.

In the embodiment of FIG. 3, each cam 8, 10 has been replaced by a pair of cams 9, 11 which rotate in the directions indicated by the arrows in FIG. 3 when cables 22, 24 disposed between the cams 9, 11 are subjected to an axial pull-out load. Since the passageways are defined by confronting cams 9, 11 which both are capable of rotational movement in response to axial pull-out loads, the passageways 18, 20 are reduced in size in a manner more responsive than the embodiments of FIGS. 1 and 2, and accordingly this embodiment may be more desirable in environments where relatively large axial pull-out forces are expected and high resistance thereagainst is deemed necessary.

Figure 4:
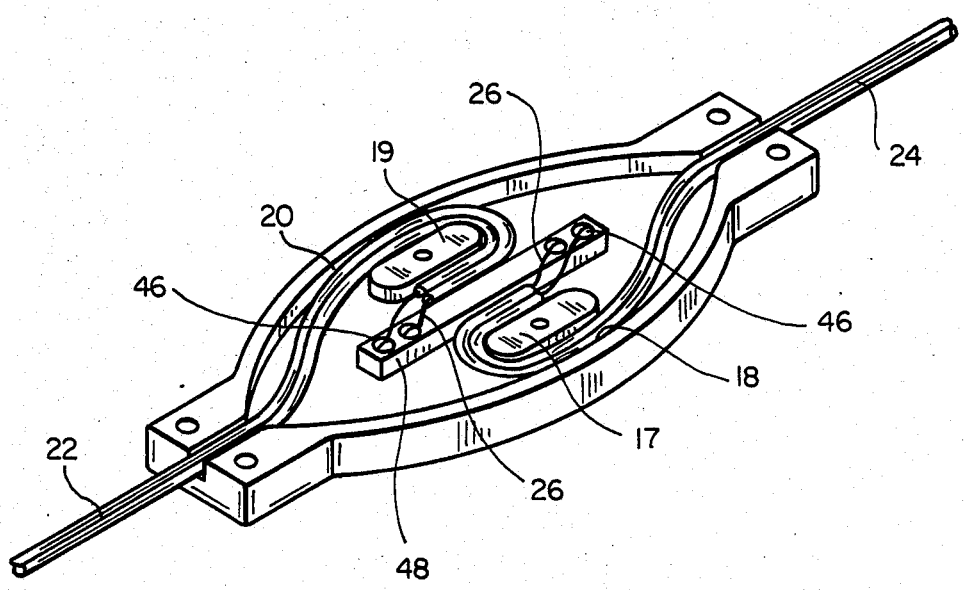
FIG. 4 illustrates an embodiment which utilizes first and second cantilevers for varying the size of first and second variable-sized passageways.

FIG. 4 illustrates an alternative embodiment of the invention wherein a connector bar or block 48 is disposed between first and second pivoted cantilevers 17, 19, the bar 48 having a plurality of electrical connection ports 46 thereon adaptable to being connected to the conductors 26 of the first and second cables 22, 24. Here, the cantilevers function as the cams of the prior embodiments to narrow the passageways 18, 20 when the cables 22, 24 are subjected to axial loads.

Figure 5:
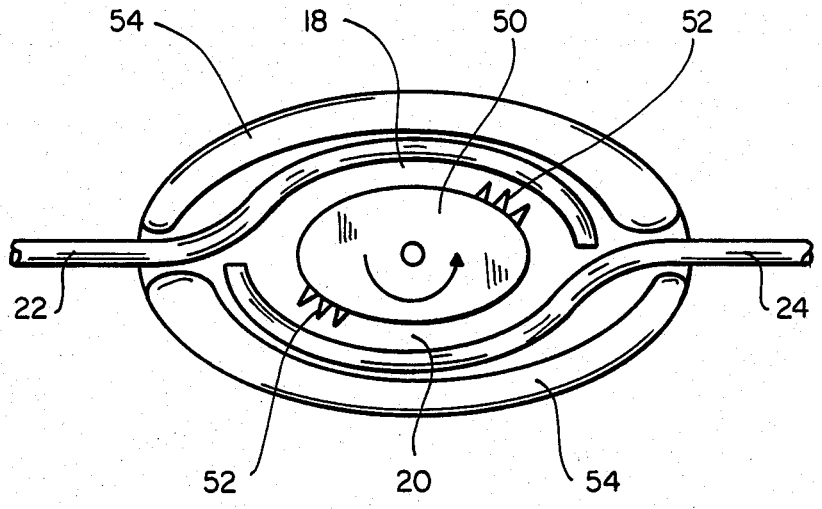
FIG. 5 illustrates an embodiment utilizing a single cam with insulation-piercing means disposed thereon.

In the embodiment of FIG. 5, the cams 8, 10 of FIG. 1 are replaced by a single electrically conductive cam 50 having insulation-piercing members 52 on opposite surfaces thereof with members 54 confronting the opposite surfaces of the cam 50 so as to again define first and second variable-sized passageways 18, 20 therebetween. With this structure, the cables 22, 24 are positively secured within the closure and are electrically interconnected since the insulation-piercing members 52 pierce an insulating jacket of the cables and make electrical contact with electrical conductors 26 therewithin. Since the cam 50 is made of an electrically conductive material, good electrical interconnection results. Again, the confronting means 54 which cooperate with the cam 50 to define first and second variable-sized passageways 18, 20 are preferably constructed of a relatively inexpensive plastic material, thus rendering the closure inexpensive and light in weight.

Figure 6:
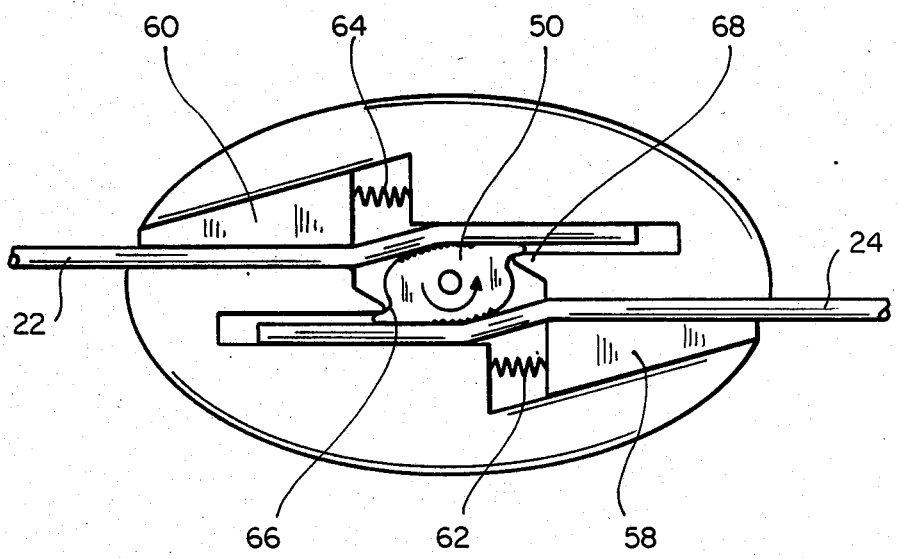
FIG. 6 illustrates an improvement over the embodiment of FIG. 5 wherein first and second wedges are further included for facilitating pull-out resistance of first and second cables.

In FIG. 6, axial pull-out resistance is enhanced by first and second wedges 58, 60 biased longitudinally in a direction of an apex line or of narrowing taper of first and second wedge-shaped sections of the first and second variable-sized passageways, the biasing being accomplished by first and second springs 62, 64. This embodiment is advantageous in that the closure can be made narrower and more compact in size. If desired in this or any of the other preferred embodiments, means can be provided for locking the cams after a predetermined degree of rotation, such a cam locking means being illustrated by the cooperation of indentations 66 on the cam 50 and cooperating shoulders 68.

Figure 7:
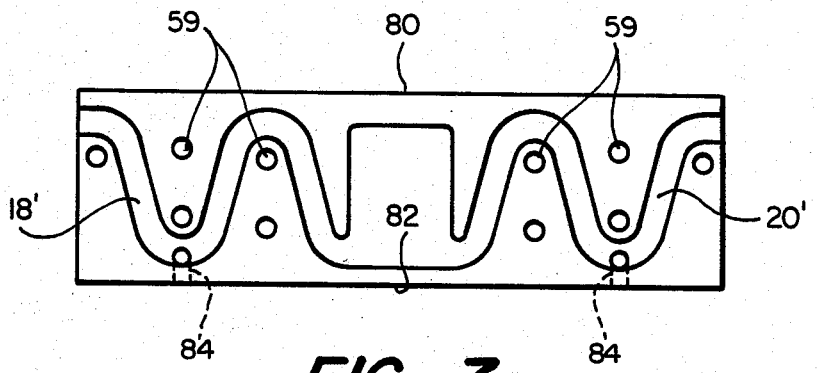
FIGS. 7 and 8 illustrate embodiments which utilize fixed-sized passageways.

FIG. 7 illustrates an alternative preferred embodiment of the invention wherein the first and second variable-sized passageways 18, 20 of the other embodiments are replaced by fixed-sized passageways 18', 20' shaped such that, when first and second cables are inserted therein and subjected to axial pull-out forces, the stiffneses of the cables in conjunction with frictional forces generated between the cables and the passageways are capable of preventing the first and second cables from pulling out of the connector, and are further capable of relieving any junction between the cables of the pull-out stress. In the embodiment of FIG. 7, the passageways are serpentine-like shaped and preferably include at least two bends of opposite sense each of which has a radius of curvature in excess of 30°, preferably in excess of 45°, and most preferably in excess of 60°, or any combination thereof. Outlets of the passageways preferably are offset toward a common side 80 of the closure so that when suspended by the cables 22, 24, gravity will cause an opposite side 82 to face downward. Hence, water drainage holes 84 at a first lower-most turn of the passageways allow ready removal of water which may propagate down the cables.

Figure 8:
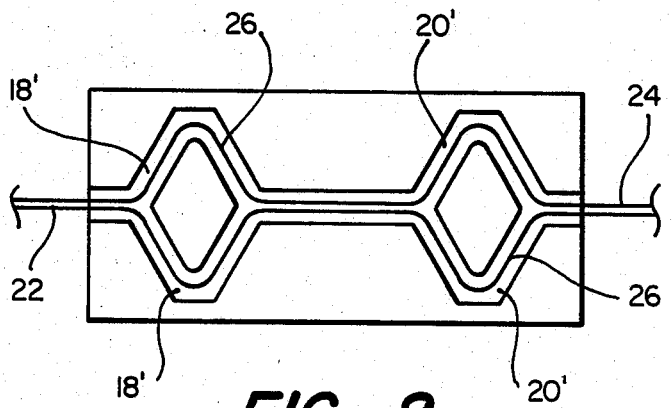

In an alternative embodiment illustrated in FIG. 8, the first and second passageways are diamond-like shaped, which embodiment allows conductors 26 to be disposed therein along different mirror-image paths, this embodiment being particularly useful for two-pair drop-wire splices. The embodiments of FIGS. 7 and 8 have advantages of reduced complexity of design and hence reduced cost since cam(s) do not need to be separately manufactured and installed within a casing, and the entire closure can be formed by a relatively inexpensive and simple molding technique.

Figure 9:
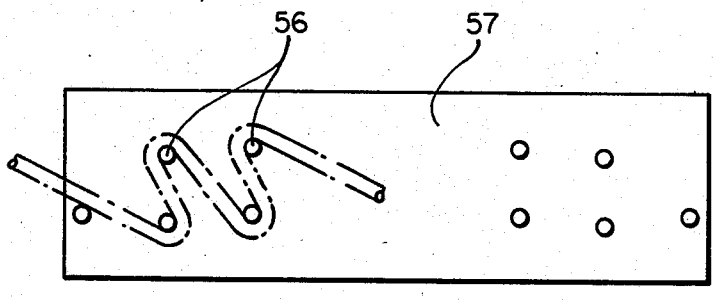
FIG. 9 illustrates a cover having cable-shaping pins disposed thereon usable with the embodiment of FIG. 7.

A wire-bending jig 57 is illustrated in FIG. 9 which comprises a plurality of pins 56 disposed on a substrate. Without the wire-bending jig 57, a craftsman would be required to bend the cables 22, 24 in the serpentine-type shape, diamond-like shape, etc., and then fit the bent cables into the fixed-sized passageways 18', 20'. Such a procedure might be difficult in adverse environmental conditions such as sub-zero temperatures, and accordingly the craftsman can simply utilize the wire-bending jig of FIG. 9 to wrap the cable 22 or 24 (or conductors thereof) around the pins 56 in the required shape which facilitates and renders easy the bending of the cable 22, 24. The pins 56 are adaptable for insertion into slots 59 in the closure of FIG. 7 or of FIG. 8, and in the case of other embodiments, a gel can be used to fill the closure if desired. By proper design, the pins 56 and slots 59 can be used to clamp the connector together, a typical design being arrowhead-type pins.

All embodiments described of course include covers for encasing the cable ends, though such covers are not illustrated in all the drawings for ease of illustration. Where only mechanical or electrical connection is desired, the covers are not deemed necessary, though desirable.

The various embodiments described are all suitable for aerial drop wire and, alternatively buried drop-wire connectors and closures. Though the invention has been described with reference to certain preferred embodiments thereof, it should be understood that the invention is not intended to be limited thereby, and is to be limited only by the appended claims.

What is claimed is:

1. A closure comprising:

first and second pivoted cam means;

means confronting the first and second cam means and cooperating therewith to define first and second variable-sized passageways, a first cable being inserted through the first passageway and a second cable being inserted through the second passageway;

the first and second cam means being pivoted and oriented so as to decrease a size of the first and second variable-sized passageways, respectively, in response to pull-out forces exerted on either the first or second cable; and further comprising a first electrical connection bar having at least one electrical connection port thereon adapted to be electrically connected to an electrical conductor of one of the first and second cables.

2. The closure of claim 1, the first and second cables being aerial cables, the second cable including a stop wire.

3. The closure of claim 1, the first and second cables being buried cables, the second cable including a drop wire.

4. The closure of claim 1, the first and second cam means each having a series of serrations on surfaces thereof confronting the first and second cables for increasing a gripping force on the first and second cables, respectively.

5. The closure of claim 1, further comprising a second electrical connection bar electrically connected to the first electrical connection bar.

6. The closure of claim 1, further comprising a casing having a cavity therein for accommodating first and second cable electrical connection means, the casing including first and second casing halves, the first casing half containing the first and second means and the first and second confronting means, one of the casing halves containing a gel.

7. The closure of claim 6, the cam means and casing halves being made of plastic.

8. The closure of claim 1, the first cam means and first connection bar being located in a casing such that a shape of the first variable-sized passageways is such that the first cable is bent around an angle in excess of 160°.

9. The closure of claim 8, the angle being in excess of 180°.

10. The closure of claim 1, the electrical connection bar being disposed between the first and second cam means, the connection bar having a plurality of electrical connection ports adapted for being electrically connected to conductors of the first and second cables.

11. The closure of claim 10, the first and second cam means comprising first and second cantilevers.

12. A closure comprising:

first and second pivoted cam means;

means confronting the first and second cam means and cooperating therewith to define first and second variable-sized passageways, a first cable being inserted through the first passageway and a second cable being inserted through the second passageway;

the first and second cam means being pivoted and oriented so as to decrease a size of the first and second variable-sized passageways, respectively, in response to pull-out forces exerted on either the first or second cable; and further comprising third and fourth pivoted cam means, the first and third cam means cooperating to define the first variable-sized passageway, the second and fourth cam means cooperating to define the second variable-sized passageways, the first and third, and the second and fourth cam means being pivoted and oriented so as to respectively each decrease a size of the first and second variable-sized passageways, respectively, in response to pull-out forces exerted on the first and second cables.

* * * * *